US006507321B2

(12) United States Patent
Oberschmidt et al.

(10) Patent No.: US 6,507,321 B2
(45) Date of Patent: Jan. 14, 2003

(54) V-SLOT ANTENNA FOR CIRCULAR POLARIZATION

(75) Inventors: Gerald Oberschmidt, Bruschsal (DE); Veselin Brankovic, Esslingen (DE); Dragan Krupezevic, Stuttgart (DE)

(73) Assignee: Sony International (Europe) GmbH, Berlin (DE)

( * ) Notice: Subject to any disclaimer, the term of this patent is extended or adjusted under 35 U.S.C. 154(b) by 0 days.

(21) Appl. No.: 09/866,200

(22) Filed: May 25, 2001

(65) Prior Publication Data

US 2002/0000943 A1 Jan. 3, 2002

(30) Foreign Application Priority Data

May 26, 2000 (EP) ..... 00 111 418

(51) Int. Cl.[7] ..... H01Q 13/10
(52) U.S. Cl. ..... 343/770; 343/767; 343/795
(58) Field of Search ..... 343/700 MS, 767, 343/770, 795, 846, 860

(56) References Cited

U.S. PATENT DOCUMENTS 4,644,343 A 2/1987 Schneider et al. ..... 343/767
5,404,146 A * 4/1995 Rutledge ..... 343/720
6,018,320 A * 1/2000 Jidhage et al. ..... 343/700 MS
6,052,093 A * 4/2000 Yao et al. ..... 343/770
6,191,740 B1 * 2/2001 Kates et al. ..... 343/700 MS

FOREIGN PATENT DOCUMENTS

EP 0 401 978 12/1990

* cited by examiner

*Primary Examiner*—Don Wong
*Assistant Examiner*—Shih-Chao Chen
(74) *Attorney, Agent, or Firm*—Frommer Lawrence & Haug LLP; William S. Frommer

(57) ABSTRACT

The present invention relates to a circular polarized antenna comprising a planar dielectric substrate comprising a front and a back dielectric face, at least one subantenna means comprising a first and second element for radiating and receiving circular polarized electromagnetic signals, at least one transmission line means for transmitting signals from and to said at least one subantenna means, wherein the antenna is characterized in that the first and second elements of the subantenna means are slots arranged orthogonal to each other in a V-shape on the front dielectric face of the substrate and in that the transmission line means are arranged on the back dielectric face of the substrate. This structure provides a simple configuration which can be produced at low costs and is suitable for the use in a planar array antenna, in particular due to the decoupling of the feed system from the radiating element.

1 Claim, 6 Drawing Sheets

V-SLOT ANTENNA FOR CIRCULAR POLARIZATION

Figure 1:
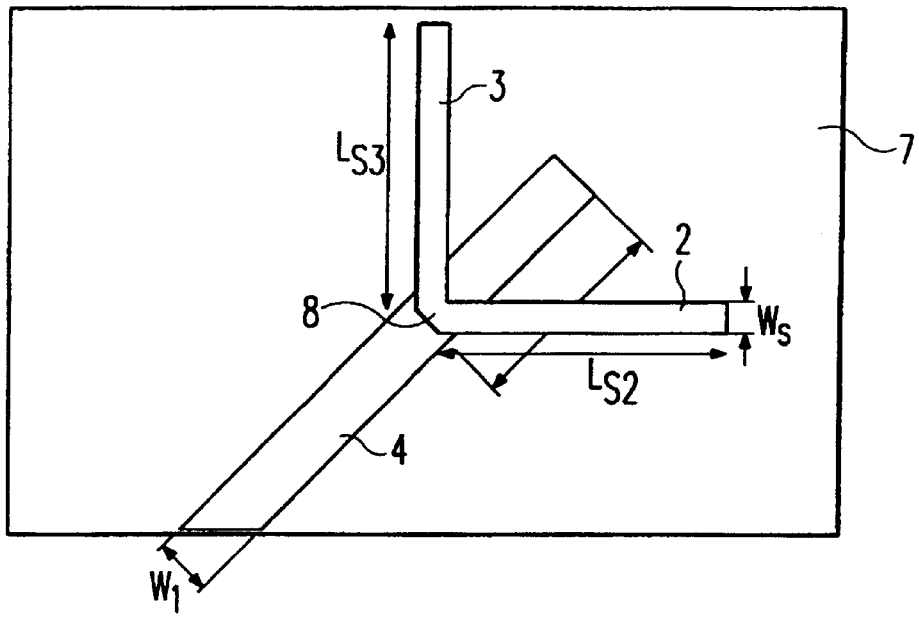

The present invention relates to an antenna for radiating and receiving circular polarized electromagnetic signals in particular signals with microwave or mm-wave frequencies.

Such antennas are of particular interest for high data rate applications, such as wireless communication systems in the microwave or mm-wave regime. Typical applications of that type are satellite-earth-communication, indoor wireless LANS or outdoor LOS private links. These applications require large bandwidths which can only be granted in very high frequency regions as e.g. from 15 GHz to 60 GHz. The circular polarization is necessary in order to omit the requirement for the user to observe the orientation of the antenna.

Antennas providing circular polarization are described in the prior art. Planar antennas in this field mainly make use of a microstrip technology, In EP 0 215 240 B1 for example, a planar-array antenna for circularly polarized microwaves is described. This antenna comprises a substrate being sandwiched between two metal layers. Openings are formed in both of the metal layers. In these openings excitation probes are provided on the substrate. An antenna of this design has the disadvantage that the structure thereof is rather complex and that the probes have to be aligned accurately with the openings in the metal layers, in order to comply with the required tolerances. This complex structure and alignment requires additional manufacturing steps and advanced technology.

Therefore, the object of the present invention is to provide an antenna which allows applications into the mm wave frequencies with good efficiency and is simple in structure.

This object is achieved by an antenna comprising a planar dielectric substrate, comprising a front and a back dielectric face, at least one subantenna means, comprising a first and second element for radiating and receiving circular polarized electromagnetic signals and at least one transmission line means for transmitting signals from and to said at least one subantenna means, whereby the antenna is characterized in that the first and second elements of the subantenna means are slots arranged orthogonal to each other in a V-shape on the front dielectric face of the substrate and that the transmission line means is arranged on the back dielectric face of the substrate.

The main advantages of the antenna according to the present invention are its simple structure and the decoupling of the feed network from the radiating elements, i.e. the slots. The simplicity of this planar antenna structure is given by the fact that the feed line and the subantenna means are both formed on one dielectric substrate on opposite sides thereof. For the inventive arrangement, hence, already a single layer substrate suffices. An additional alignment of a path on an upper layer is therefore not required. Such alignments are mandatory for aperture coupled patch path antennas. The tolerance is very small for high frequencies and therefore such an alignment is a tedious task. The possibility of omitting such an alignment during manufacturing of the antenna allows the use of cheaper technology and thereby decreases the overall costs. Simple planar technology, printed technology and/or simple and cheap photo lithographic processing of prints can be utilized. The simple structure and low costs are a strong necessity for a commercial success of an antenna and are met by the inventive structure. In addition the inventive antenna of the planar printed type is very easy to integrate with active devices on the same substrate.

With the feed line, which in particular for array configurations may be connected to an additional feed network, being arranged on the opposite side of the substrate from the subantenna means, it is ensured that the radiation of the antenna is only determined by the subantenna means, namely the radiating slots, which are well controllable.

The feed line which can be of microstrip structure is preferably arranged on the opposite side of the substrate under an angle of 45° to each of the slots. With this position of the feed line the coupling section can be perpendicular to the direction of the feed line, in order to allow an even distribution of the power between the two slots. With the structure of the subantenna means comprising two slots arranged orthogonal to each other and being arranged in a V-shape the vertical slot can radiate the horizontal component and the horizontal slot can radiate the vertical component of the electromagnetic signal. A circular radiation of the antenna can thus be obtained by this simple structure.

Further advantageous features of the antenna according to the present invention are defined in the subclaims.

In a preferred embodiment the first or the second element of the subantenna means is greater in length than the other. The elements of the subantenna means are the slots arranged in a V-shape orthogonal to each other. The slots preferably have a rectangular shape with a bridge portion connecting them at the meeting point of the V-shape. Other forms can, however, also be realized in the antenna according to the invention, provided that the shape of the slots allows the desired excitation of electromagnetic signals and the lines extending through the middle of the slots in their longitudinal direction are perpendicular to each other. In one embodiment of the invention the width of each of the first and second element of the subantenna means increases from their feeding side to the opposite side thereof. The slots hence each have a tapered shape with the central lines of the two slots extending in their longitudinal direction being perpendicular.

The total slot length, being the sum of both slots of the subantenna means, is approximately one guided wavelength in the slot. If however one of the two slots is longer than the other, the field excited within the total slot has a 90°-phase difference between the components in the vertical and the horizontal slot or arms of the V-shape. This leads to a phase shift of 90° between the vertical and the horizontal component which are radiated by the horizontal and the vertical arm, respectively. Due to this phase shift a circular polarized radiation at the correct frequency of operation can be obtained.

The transmission line can have various designs in order to match the antenna. The feed line preferably represents a microstrip line. In one embodiment the transmission line may comprise a first line for to the first element of the subantenna means and a second line for to the second element of the subantenna means, said first and second line being coplanar to each other. In a further embodiment the feed line includes a tapered portion. This structure of the feed line is in particular advantageous for instances where the real part of the impedance cannot be tuned to the characteristic impedance of the feed. In these cases, when the real part of the impedance is low, a low impedance microstrip line is used in the coupling region and is matched through the taper structure to the desired microstrip line. Naturally any other kind of known matching structure can be used.

The subantenna means and the transmission line are arranged on a dielectric substrate, which preferably has a dielectric constant of $\epsilon_r \geqq 1$. Suitable material for the dielectric substrate is for example Teflon-fiberglass with a dielectric constant of 2.17. The subantenna means are slots which are preferably formed in a metal coated area on one of the faces of the dielectric substrate. They can be obtained by metallizing one side of the substrate and etching the slots into the metallic layer by known etching techniques. The feed structure is obtained by applying metal to the opposite side of the substrate in the desired shape.

The antenna according to the present inventions can advantageously further comprise a reflector means. This reflector means which is normally represented by a reflector plate or plane can be spaced to and parallel with the back face of the dielectric substrate. Between said reflector means or plate and said back face of the substrate, low loss material should be located. Even though the inventive antenna can be operated without any reflector means, such means can be added in order to enlarge the broadside gain of the antenna and to cancel the backside radiation.

The inventive antenna is in particular suitable for being arranged as an antenna element in a phase antenna array comprising a plurality of antenna elements. The planar phase antenna array can be obtained by arranging several subantenna means each including two perpendicular slots on one substrate and feeding this arrangement by means of a feeding network, located on the opposite side of the substrate. In such an array configuration, the advantageous of the present invention specifically come to fruition. The arranging of the feed line on the opposite side of the substrate from the subantenna means provides a possibility of decoupling of the feed network from the radiating structure. With conventional antennas, in particular in array configuration, spurious unwanted radiation components are observed from the feed network. These components greatly decrease the axial ratio and are therefore undesirable. In the antenna according to the present invention in contrast the feeding network is completely decoupled from the subantenna means and thus the radiation is only determined by the well controllable subantenna means, namely the radiating slots. Reflections from mulitpath effects will be significantly attenuated.

Figure 2:
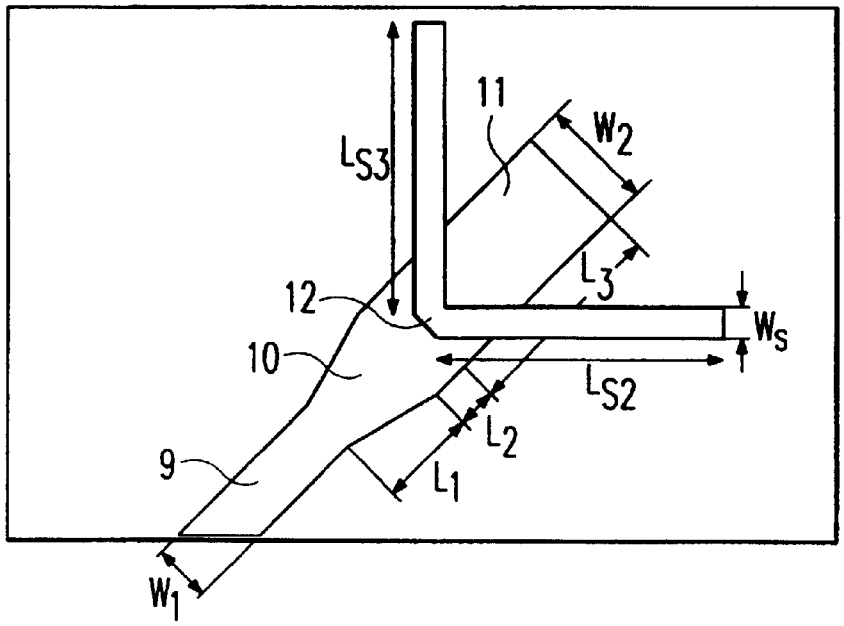
Figure 3:
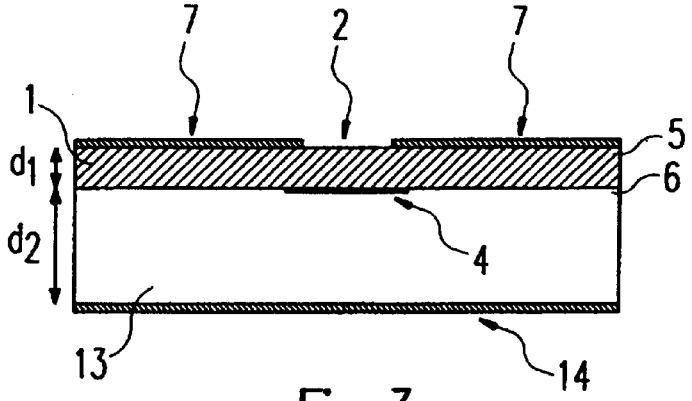
Figure 4:
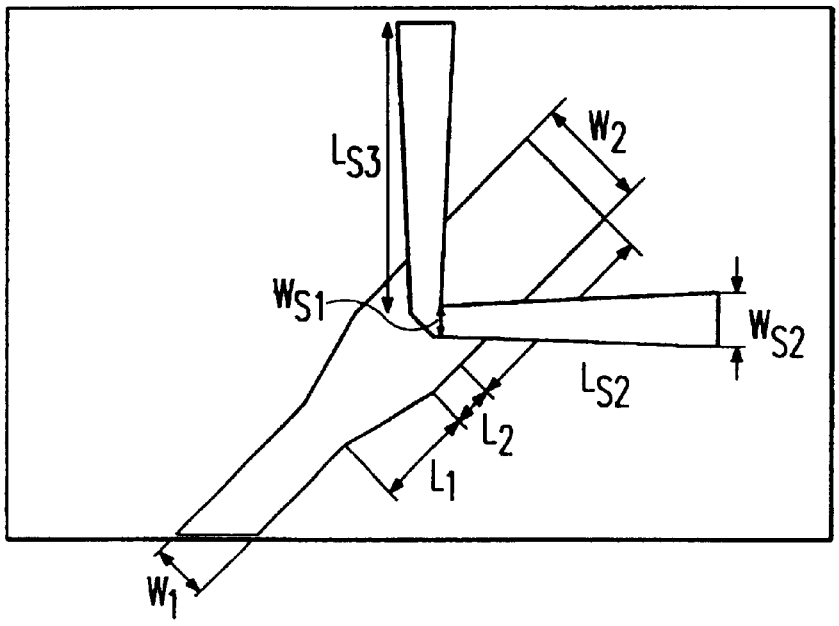
Figure 5:
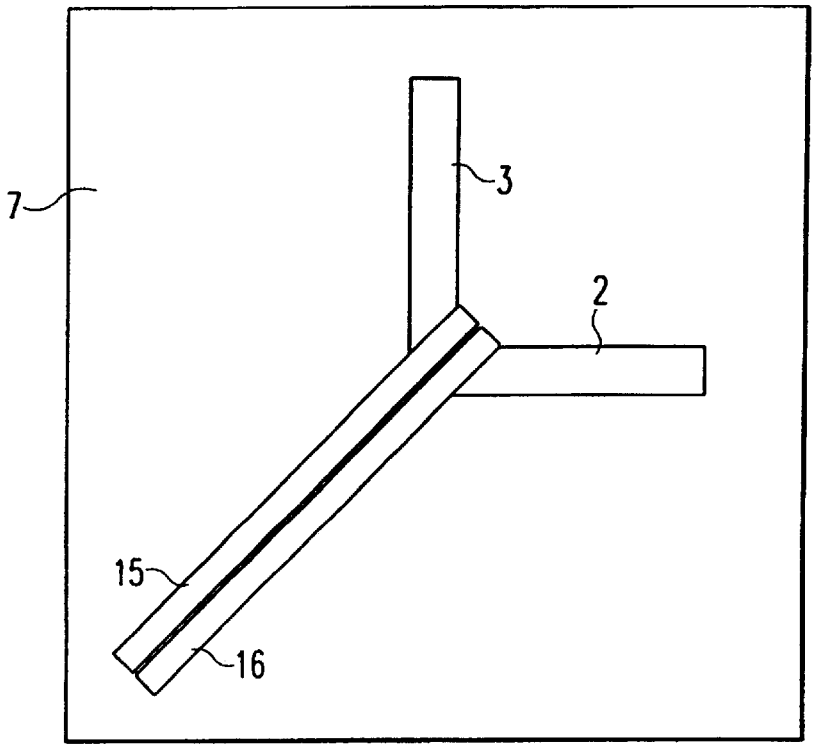
Figure 6:
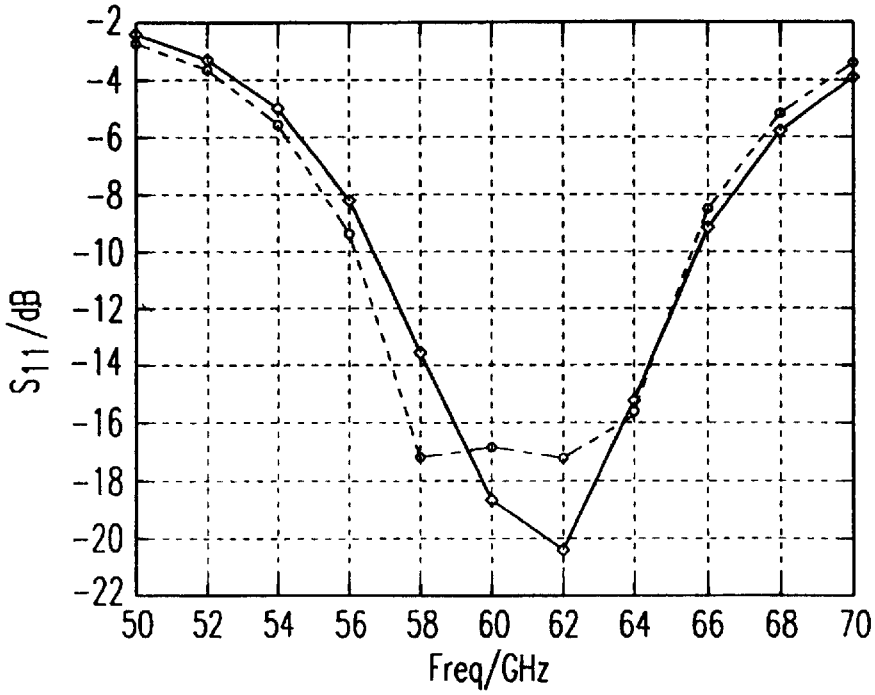
Figure 7:
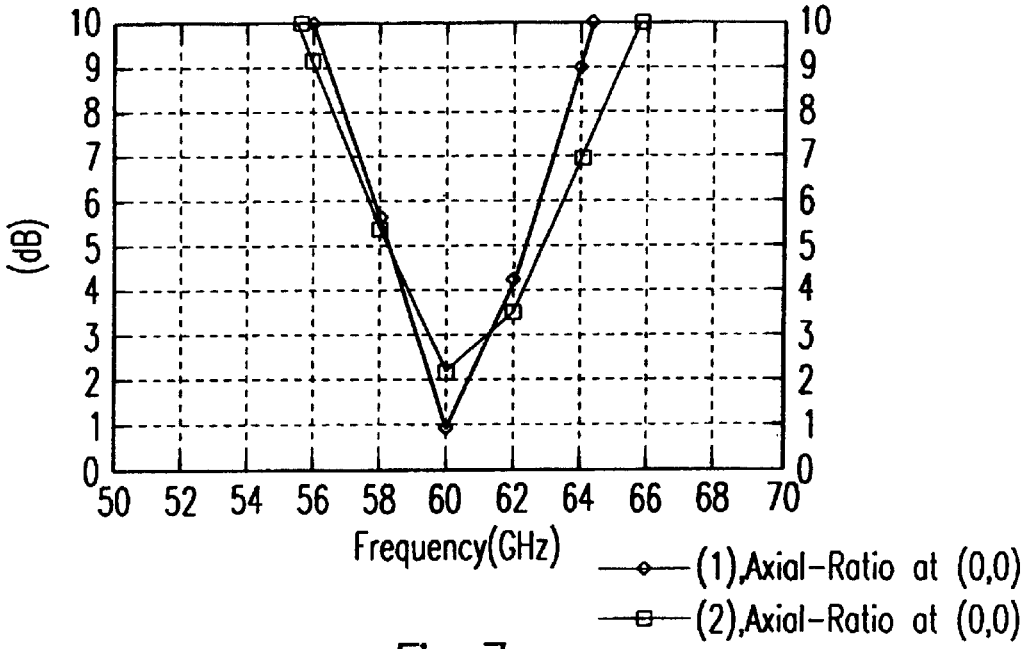

The present invention will in the following be explained in more detail by means of a preferred embodiment with reference to the enclosed drawings, wherein:

FIG. 1 shows a schematic top view of a first embodiment of the present invention, FIG. 2 shows a schematic top view of a second embodiment of the present invention, FIG. 3 shows a schematic cross-sectional view of an antenna according to the present invention, FIG. 4 shows a schematic top view of a third embodiment of the present invention, FIG. 5 shows a schematic top view of a fourth embodiment of the present invention, FIG. 6 shows a simulation result of the antenna return loss versus the frequency, FIG. 7 shows a simulation result of the axial ratio of two antennas according to present invention.

Figure 8:
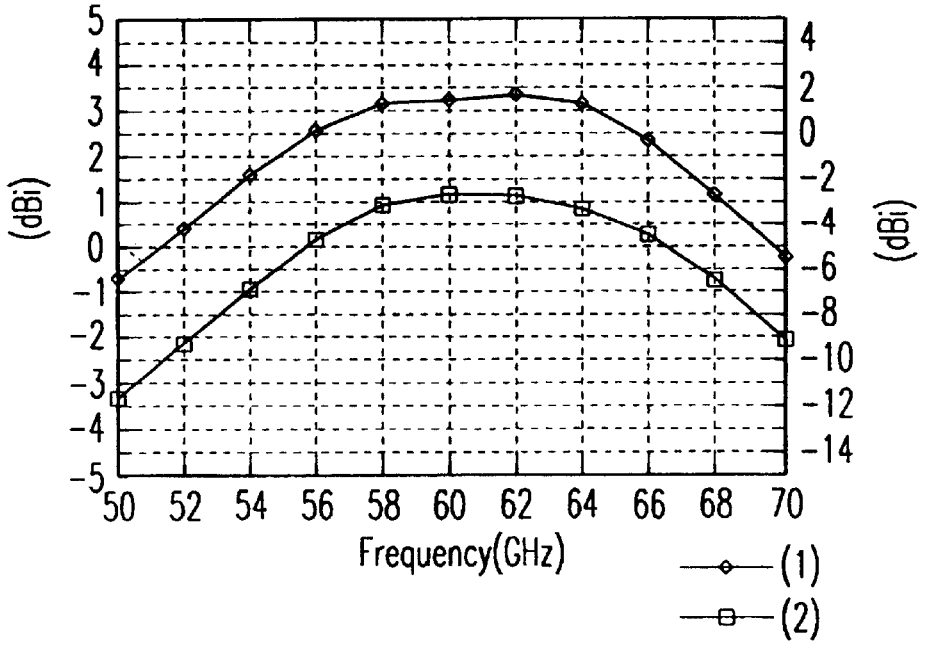
Figure 9:
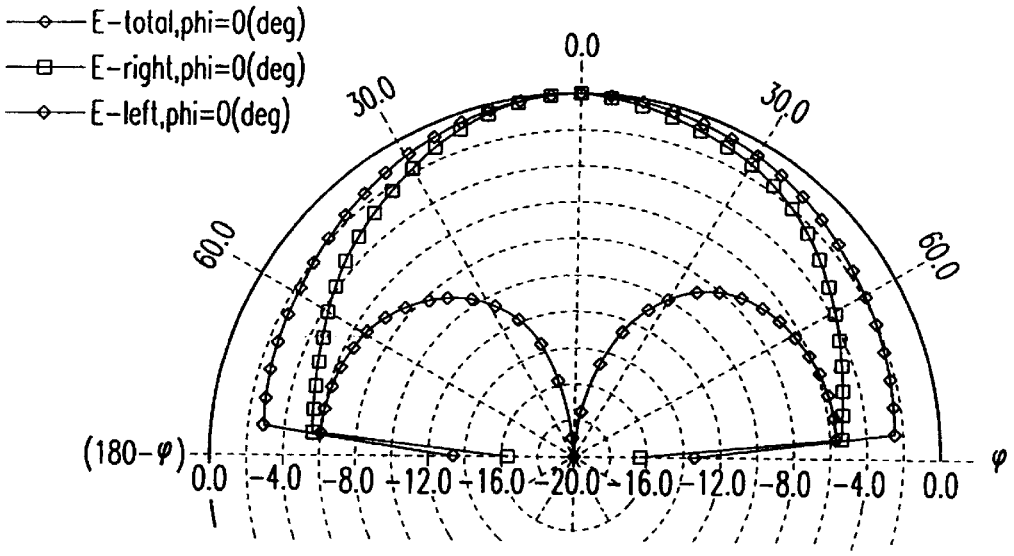
Figure 10:
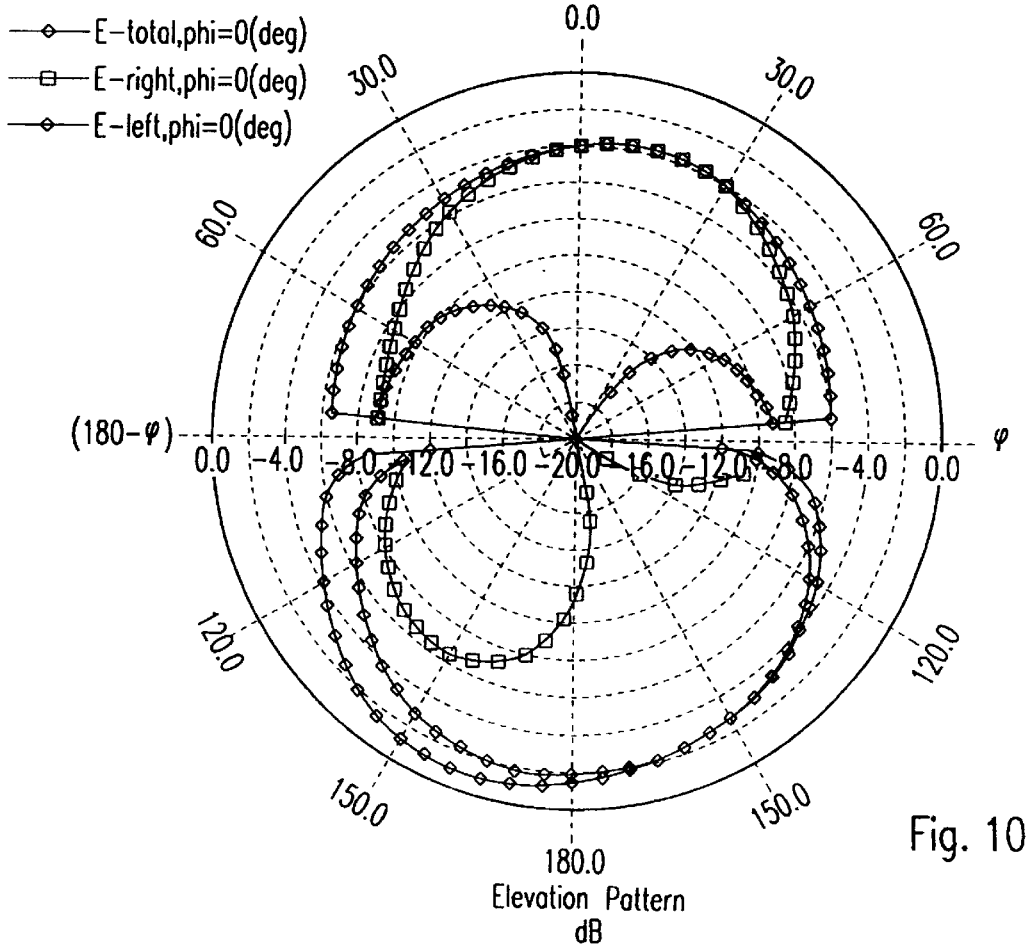

FIG. 8 shows a simulation result of the gain of two antennas in upward direction versus the frequency, FIG. 9 shows a simulation result of a radiation diagram in direction of the horizontal slot for an antenna according to the present invention with reflector means, FIG. 10 shows a simulation result of a radiation diagram in direction of the horizontal slot for an antenna according to the present invention without reflector means.

Figure 11:
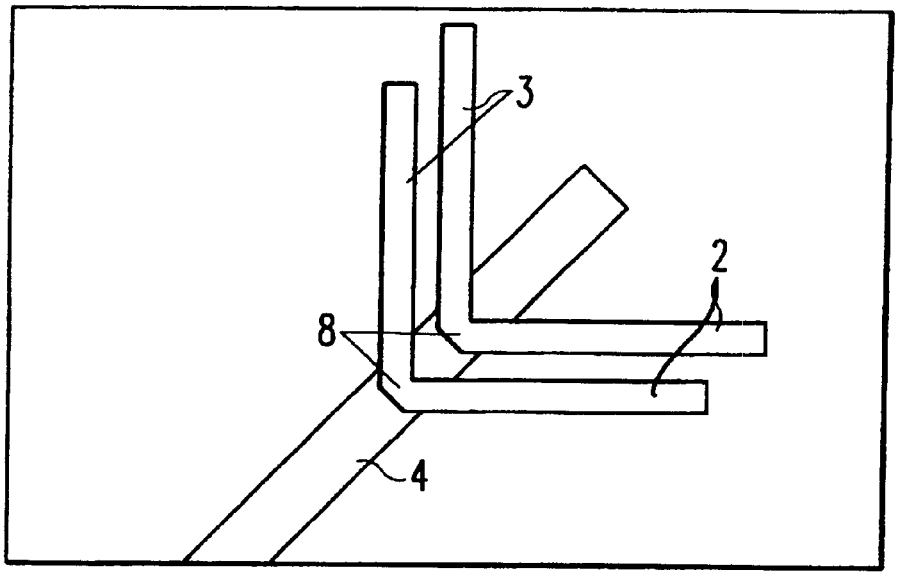

FIG. 11 shows a diagram of a phase antenna array comprising a plurality of antenna elements according to an embodiment of the present invention.

FIG. 1 shows a schematic top view of an antenna according to the present invention, with a projection of slots 2, 3 on a front face 5 and feed line 4 on a back face 6 of a dielectric substrate 1 in a common plane. In the antenna according to the present invention the slots 2, 3 can be formed on the front face 5 of the dielectric substrate 1 by etching a metallic layer 7, which had been applied to the front face 5 of the substrate 1. The slots 2 and 3 are arranged under an angle of 90° to each other in a V shape.

In the example shown in FIG. 1 the slots 2 and 3 each have a rectangular shape and are connected on their feeding side via a bridge portion 8. This bridge portion 8 is smaller in width than the slots 2 and 3. From this connection of the two slots 2 and 3 an overall shape of the subantenna means 2, 3, 8 results in a V-shape with the bottom tip 12 of the V being flattened. The slot 2 has a length $L_{s2}$ and the slot 3 has a length $L_{s3}$. In the shown embodiment slot 3 is slightly longer than slot 2 and both slots have a width of $W_S$. It is however also within the scope of the invention to provide an antenna wherein the width of the first slot of the subantenna means is smaller than the width of the second slot arranged perpendicular to the first slot. As can be derived from FIG. 1 the angle between the two slots 2 and 3 is 90°.

On the opposite side of the substrate 1 a feed line 4 for guiding the exciting wave to and from the slots 2 and 3 is provided. In the embodiment of FIG. 1 the feed line 4 is a microstrip feed line with a constant width W. The feed line 4 is arranged as to pass through the angle of 90° formed between the slots 2 and 3 at an angle of 45°. The length $L_3$ is the portion of the feed line that overlaps with the area defined by the slots 2 and 3. This length $L_3$ can be adjusted in order to minimize the imaginary part of the complex impedance in the coupling plane. This way the antenna structure can be effectively matched to the characteristic impedance of the feed line, which can for example be 50Ω. The end of the feed line 4 opposite to the portion of the length $L_3$ can be connected to a feeding network (not shown). With the inventive antenna no hybrids or power dividers are required, for the feeding network.

The total length of the slot ($L_{s1}$+$L_{s2}$) is approximately one guided wave length in the slot. This length as well as the width of the slot $W_S$ can be adjusted in order to yield the correct real part of the impedance of the coupling and to yield the correct phase angle of the field components for a circular polarized wave.

The function of the antenna is as follows. The exciting wave is guided to the slot 2 and 3 through the microstrip line 4. This line 4 is not mechanically connected to the slots 2 and 3. In the area of the slots 2 and 3 the magnetic field component of the guided wave rather excites an electric field within the slots 2 and 3. With the length of the slots 2 and 3 being suitably adjusted as explained above a circular polarized radiation at the correct frequency of operation is obtained.

In FIG. 2 a second embodiment of the invention is shown. In this embodiment also the slots 2 and 3 are provided on the front dielectric face 5 of the substrate 1. The feed line employed in this embodiment has a first section 9 which terminates into a second tapered portion 10 and results in a wider strip 11. The wider strip 11 partially overlaps with the area spanned by the slots 2 and 3. This overlapping portion will be referred to as the stub and has a length of $L_3$. The wider strip 11 however also extends further over the flattened end 12 of the V-shaped structure of the slots 2 and 3 towards the tapered portion 10. The length of the stub L3 can be adjusted in order to minimize the imaginary part of the complex impedance in the coupling plane. The portion of the wider strip 11 which is positioned between the stub and the taper 10 is of smaller length than the stub. The length of this intermediate portion has to be adjusted in order to ensure an even guiding of the exiting wave to the slot area. The end of the first section 9 of the feed line 4 opposite to the taper 10 can be connected to a feeding network.

In FIG. 3 a schematic cross-sectional view of an antenna according to the invention is shown. The substrate 1 is covered on its front face 5 by a metallic layer 7. In this layer slots 2 and 3 are located (only slot 2 is shown in FIG. 3). On the opposite side of the substrate 1, the back dielectric face 6, the feed line in form of a microstrip line 4 is shown. The feed line is preferably a metallic line which is applied to the back face 6. It is, however, also within the scope of the invention to form the feed line 4 by a slot in a metallic layer applied to the back face 6 of the substrate 1.

The embodiment shown in FIG. 3 is an embodiment wherein the dielectric substrate is supported by a low-loss material 13, on the opposite side of which a reflector means 14 in form of a metal reflector plane is located. The reflector plane 14 is parallel to the back face 6 of the substrate 1. The low-loss material 13 can be polyurethane, a free space filled with air or some other low-loss material with a dielectric constant close to 1, preferably less than 1.2. The reflector means serve to enlarge the broadside gain of the antenna. For this purpose the distance of the reflector plane to the back face of the dielectric substrate 1 can be adjusted accordingly. The distance of the reflector plane, in particular its distance to the middle of the substrate 1 is advantageously about a quarter (electrical) wavelength of the center frequency (of the working band).

In FIG. 4 a third embodiment of the present invention is shown. This embodiment essentially corresponds to the embodiment shown in FIG. 2. In FIG. 4 however the slots 2 and 3 are tapered. The width $W_S$ increases from the feeding side of the slot to its opposite side. The widths $W_{S1}$ and $W_{S2}$ as well as the length of the slots $L_{s2}$ and $L_{s3}$ are adjusted to obtain a correct real part of the impedance in the plane of coupling and a correct phase angle of the field components for a circular polarized wave.

In FIG. 5 a fourth embodiment of the invention is shown. In this embodiment the feed line is represented by a coplanar feed line consisting of two separate lines 15 and 16. Lines 15 and 16 are located on the back face 6 of the substrate 1, whereas slots 2 and 3 are located on the front face 5. In the shown embodiment the slots 2 and 3 are not interconnected. Line 15 supplies slot 3 whereas line 16 supplies slot 2.

Any of the embodiments shown in FIG. 1 through 5 are suitable for use in a phase array antenna configuration. FIG. 11 illustrates an example of a phase array antenna.

In order to show the excellent operation values of the antenna according to the invention simulation tests have been made. An antenna as shown in FIG. 2 is considered with and without reflection plane for operation at 60 GHz. The antennas used had the geometrical and electrical parameters as shown in the following table:

| Measure | Antenna (1) (with reflector plane) | Antenna (2) (without reflector plane) |
|---|---|---|
| D1 | 0.127 mm | 0.127 mm |
| $\epsilon r$ | 2.2 | 2.2 |
| D2 | 1.4 mm | — |
| Impedance Feed | 50 Ω | 50 Ω |
| Impedance Coupler | 25 Ω | 25 Ω |
| W1 | 0.4 mm | 0.4 mm |
| W2 | 0.8 mm | 0.8 mm |
| L1 | 0.7 mm | 0.7 mm |
| L2 | 0.3 mm | 0.3 mm |
| L3 | 1.47 mm | 1.47 mm |
| Ws | 0.17 mm | 0.17 mm |
| LS2 | 2.315 mm | 2.265 mm |
| LS3 | 2.075 mm | 1.965 mm |

The simulated results of operating these antennas obtained by using a MPIE (Mixed potential integral equation) based planar software are shown in FIGS. 6 through 10.

In FIG. 6 the reflection coefficient S11 in dB versus the frequency in GHz for an antenna according to the present invention is shown. The frequency band from 50 to 70 GHz is covered. The dashed line indicates the input reflection coefficient of an antenna (1) with a reflection plane and the solid line indicates the input reflection coefficient of an antenna (2) without a reflection plane. It can be derived from FIG. 6 that the antenna with and without the reflection plane are both well matched between 58 and 64 GHz. This result is surprising as the coupling impedance shows a real part of approximately 25Ω.

FIG. 7 shows the axial ratio of an antenna according to present invention over the frequency. The axial ratio can be as low as 1 dB for an antenna with reflector plane at the desired frequency of 60 GHz.

In FIG. 8 the gains obtained with an antenna with and without a reflector plane are shown. From this figure it becomes obvious that the gain of an antenna with reflector plane is about 2 dB higher than the gain of an antenna without a reflector plane.

In FIGS. 9 and 10 the different gains obtained with an antenna with and without a reflector plane are shown. It can be derived from these figures that the radiation characteristic of an antenna with reflector plane is almost symmetrical whereas a small asymmetrical component is visible in the characteristic of an antenna without a reflector plate. The latter antenna also radiates a large amount of power in the backward direction, which is not desirable. Hence it can be understood that gain as shown in FIG. 8 for antenna without reflector is only 1.2 dBi in the main direction, while a gain in the main direction of 3.3 dBi can be obtained by the use of a reflector plane in the antenna. Theoretically the reflector plane should increase the gain of this antenna by 3 dB, but some power is lost due to the excitation of a mode in the parallel waveguide set up from the upper metallic layer and the reflector plane. These modes can be suppressed by the use of shorting pins around the excitation region.

What is claimed is:

1. Antenna comprising:

a planar dielectric substrate comprising a front and a back dielectric face;

at least one subantenna means comprising a first and second elements for radiating and receiving circular polarized electromagnetic signals; and at least one transmission line means for transmitting signals from and to said subantenna means, characterized in that the first and second elements of the subantenna means are slots arranged orthogonal to each other in a V-shape on the front dielectric face of the substrate, the transmission line means being arranged on the back dielectric face of the substrate, and the antenna being arranged as an antenna element in a phase antenna array comprising a plurality of antenna elements.

* * * * *